United States Patent [19]

Allis et al.

[11] 4,047,811

[45] Sept. 13, 1977

[54] AVAILABLE LIGHT MARGINAL ILLUMINATION SYSTEM

[75] Inventors: Robert F. Allis, Rochester; Vincent A. Capaccio, Ontario, both of N.Y.

[73] Assignee: Xerox Corporation, Stamford, Conn.

[21] Appl. No.: 690,474

[22] Filed: May 27, 1976

[51] Int. Cl.[2] ..... G03G 15/00

[52] U.S. Cl. ..... 355/14; 355/57

[58] Field of Search ..... 355/3 R, 14, 15, 74, 355/57

[56] References Cited

U.S. PATENT DOCUMENTS

| | | | |
|---|---|---|---|
| 3,671,121 | 6/1972 | Albert | 355/3 R X |
| 3,778,148 | 12/1973 | Fujitsuka et al. | 355/14 X |
| 3,792,913 | 2/1974 | Simmons | 355/74 X |
| 3,829,209 | 8/1974 | Buddendeck et al. | 355/3 R X |
| 3,944,356 | 3/1976 | Hayne | 355/14 X |
| 3,967,896 | 7/1976 | Looney et al. | 355/3 R |

*Primary Examiner*—Richard A. Wintercorn
*Attorney, Agent, or Firm*—James J. Ralabate; Michael H. Shanahan; Paul Weinstein

[57] ABSTRACT

A reproducing apparatus including an optical system for viewing an object such as a document and for projecting an image thereof onto a photosensitive surface selectively at a first copy image magnification or at a reduced copy image magnification. The optical system includes a lamp for illuminating the object. A margin illumination system is provided utilizing stray light derived from the lamp of the optics system for illuminating margin regions of the photosensitive surface to prevent their subsequent development. The margin illumination system is selectively operable in the reduction mode of operation.

20 Claims, 12 Drawing Figures

AVAILABLE LIGHT MARGINAL ILLUMINATION SYSTEM

BACKGROUND OF THE INVENTION

This invention relates to a multi-mode reproducing apparatus wherein in at least one of the modes of operation a marginal illumination apparatus of this invention is utilized to prevent the development of unexposed areas of a photosensitive imaging surface. The marginal illumination apparatus of this invention is particularly useful with reproducing apparatuses having the capability of providing copy images selectively at one of a plurality of magnifications. In a reduction mode of operation the copy image does not completely fill the copy sheet and the associated area of the photosensitive imaging member. If this margin of region the imaging member is not illuminated, it will develop out as a dark border which can print-out on the resulting copy sheet. In an electrostatographic system the development of the margins with toner can easily overburden the cleaning system causing cleaning failures or shortening the interval between maintenance calls.

It is, of course, known in the prior art to utilize illumination systems for erasing or discharging the photoconductive drum of an electrostatographic reproducing machine. In U.S. Pat. No. 2,927,516 to Hicks, a portion of the electrostatic image is erased in an address label printer.

U.S. Pat. Nos. 3,556,655; 3,685,894 to Lux et al. show the use of marginal illumination in association with a reproducing machine of the electrostatographic type having plural modes of operation at different copy image magnifications. In response to the selection of a reduction mode of operation the marginal illumination lamps are energized to discharge the photoconductive medium in the unimaged areas.

U.S. Patent Nos. 3,612,682 to Shelffo; 3,784,301 to Sato; 3,799,666 to Fukushima, et al., and 3,792,913 to Simmons are illustrative of the large variety of prior art systems for erasing non-image bearing margin regions of a photosensitive surface prior to development. The aforenoted systems principally utilize illumination lamps and suitably shaped shades or masks for providing the illumination necessary to erase the non-image area.

U.S. Pat. No. 3,724,942 to Gibson is illustrative of the prior art wherein shutters and utilized during fly-back of a scanning optical system for providing a high reflective surface to illuminate the inter-document areas of the photosensitive imaging member, and thereby erase the undesired non-image area between the documents.

It is also known to utilize reflective platen covers for providing illumination of the non-image areas outside an original document being copied which is smaller than the viewing platen. For example, in German OLS No. 2,364,324 to Okada, when an original smaller than the platen is copied a mask supported about the original is utilized to provide illumination of the marginal portions of the photosensitive member In U.K. Pat. No. 1,363,751 to Albert, it is proposed to use a mask having an aperture for limiting the area of the image as well as illumination means for illuminating the border area of the photoconductive element surrounding the projected image.

It is proposed, in accordance with this invention, to use available light provided by the illumination system of the optical imaging apparatus for providing marginal illumination. Preferably, the available light rays which are utilized depart from the image ray path so as not to interfere with the normal imaging function.

A variety of electrostatographic reproducing machines are commercially employed which have different modes of operation. One type of machine utilizes a moving original exposure system wherein an original document is moved past a fixed slit optical system projecting an image onto the moving photoconductive surface. These machines include a means for changing the magnification of the projected image to provide reduction copies. Exemplary of patents in this area is U.S. Pat. Nos. 3,076,392, to Cerasani et al., and 3,649,114 to Vlach et al.

Other machines have been adapted to copy stationary original documents at a variety of magnifications or reductions through the use of a scanning optical system. Exemplary of patents in this area are U.S. Pat. Nos. 3,476,478, to Rees, Jr.; 3,542,467 to Furgeson; 3,614,222 to Post; and 3,837,743 to Amemiya. Another approach which has been utilized for projecting images for reproduction at varying magnifications from a stationary original comprises full frame exposure. Exemplary of patents in this area are U.S. Pat. Nos. 3, 543,289 to Koizumi; 3,687,544 to Muller; 3,703,334 to Knechtel; and German Offenlegungsschrift No. 2,154,944 to Libby.

U.S. Pat. Nos. 3,703,334 to Knechtel an 3,837,743 to Amemiya set forth above are also significant in that they disclose the use of a separate reflector or add reflectors, respectively, which are selectively positionable in the optical path for changing the conjugate distance of the optical system for providing varying magnifications.

The aforenoted machines are adapted to provide one or more modes of copying having different magnifications. In the optical systems of these machines, some means is usually provided for changing the conjugate relationship of the object and image sides of the projection lens. This may be accomplished by translating the lens between different positions for different projected image magnifications or in accordance with an alternative approach by utilizing more than one lens whereby different lenses are selectively positionable in the optical path, depending upon the projected image magnification desired. See, for example, U.S. Pat. No. 3,779,642 to Ogawa.

Other forms of multi-mode copiers are available commercially. For example, in the Xerox 3100 LDC machine an optical system is provided which enables the machine to copy from a stationary original in a first scanning mode or from a moving original in a second fixed optical mode. This latter mode is particularly adapted for copying documents larger than the conventional viewing platen size. U.S. Pat. No. 3,900,258 to Hoppner et al. [1] is illustrative of a machine similar in many respects to the 3100 LDC machine Reproducing apparatuses including the capability of making copies from both moving and stationary originals are also described in U.S. Pat. No. 3,833,296 to Vola, and in IBM Technical Disclosure Bulletin, Vol. 12, No. 1, at page 173, June 1969.

It has been found desirable, to provide a multi-mode reproducing apparatus having various unique features of the 3100 LDC machine, including its extremely compact size, but also having the capability of reduction copying.

One approach to such a machine is described in U.S. application Ser. No. 588,971, filed June 20, 1975, to Hoppner et al. [2]. In that application a multi-mode reproducing apparatus is provided including both moving and stationary original exposure modes, with at least two modes of moving original exposure at differing copy image magnifications. The Hoppner et al. [2] machine includes a first optical mode wherein a stationary document is viewed and an image thereof is projected onto a moving imaging surface. In a second mode a document moving at a first speed synchronized to the speed of the moving imaging surface is viewed and an image thereof projected onto the imaging surface at a desired magnification. In a third mode a document moving at a second speed synchronized to the speed of the moving imaging surface is viewed and an image thereof projected onto the surface at a reduced magnification. In the reduction mode of operation a scanning optical system is held fixed at a given position and an additional optical element comprising an add mirror is inserted into the optical path in order to change the conjugate on the object side of the lens. The lens is also shifted to a new position to align it with a repositioned optical path.

SUMMARY OF THE INVENTION

In accordance with the present invention an improved apparatus is provided for illuminating non-image bearing margins of a photosensitive surface of a reproducing machine. The margin illumination system utilizes available light from within the optical cavity. The available light is derived from the illumination source of the optical system.

A reproducing apparatus is provided which includes means for forming an image on a sheet of final support material. The image forming means in turn includes means for viewing an object such as a document and for projecting an image thereof onto a photosensitive surface selectively at a first copy image magnification or at a second copy image magnification which is reduced as compared to the first copy image magnification. The photosensitive surface is arranged for movement in a given direction. The viewing means includes means for illuminating the object and means responsive to the selection of the second projected image magnification for illuminating at least one unused side margin region of the photosensitive surface. The side margin region being one of the greatest extent substantially in the given direction. Selectively operable means are provided for intercepting a portion of the illumination derived from the illumination means and for applying that portion of the illumination to the side margin.

In accordance with an alternative embodiment the viewing means includes a lens arranged along an optical path extending from the object to the photosensitive surface. In this embodiment the means responsive to the selection of the second projected image magnification illuminates at least one unused margin which may be any margin, but preferably it is a side margin region of the photosensitive surface. Means are arranged along the ray path between the lens and the object for intercepting a portion of the image rays and for applying that portion of the image rays to the margin region without their passage through the lens.

Preferably, the image rays which are intercepted have not been subjected to image reduction. Preferably the aforenoted apparatuses utilize a multi-mode optical system including at least one reflector arranged for scanning a stationary document in one mode of operation and adapted to be fixed at a given position in an alternative mode of operation for viewing a document moving at a speed synchronized to the photosensitive surface. Varying projected image magnifications are provided in the second mode of operation by selectively employing an add mirror for changing the conjugate relationship of the optical system. The add mirror is employed solely in the reduction magnification mode of operation and serves to intercept a portion of the image rays prior to their passage through the lens and apply them through an appropriate mask to the photosensitive surface in the margin region. Preferably additional reflectors are employed to intercept a greater portion of the image rays and to concentrate them at the desired margin.

Accordingly, it is an object of the present invention to provide an improved apparatus for illuminating at least one margin region of a photosensitive surface in a reproducing machine.

It is a further object of this invention to provide such a margin illumination apparatus and reproducing machine which utilizes available light from within the optical system without the necessity of additional lamps for margin illumination.

It is a still further object of this invention to provide an apparatus as above wherein the reproducing machine comprises a multi-mode machine capable of providing selectively one of a plurality of copy image magnifications.

These and other objects will become more apparent from the following description and drawings.

Figure 5:
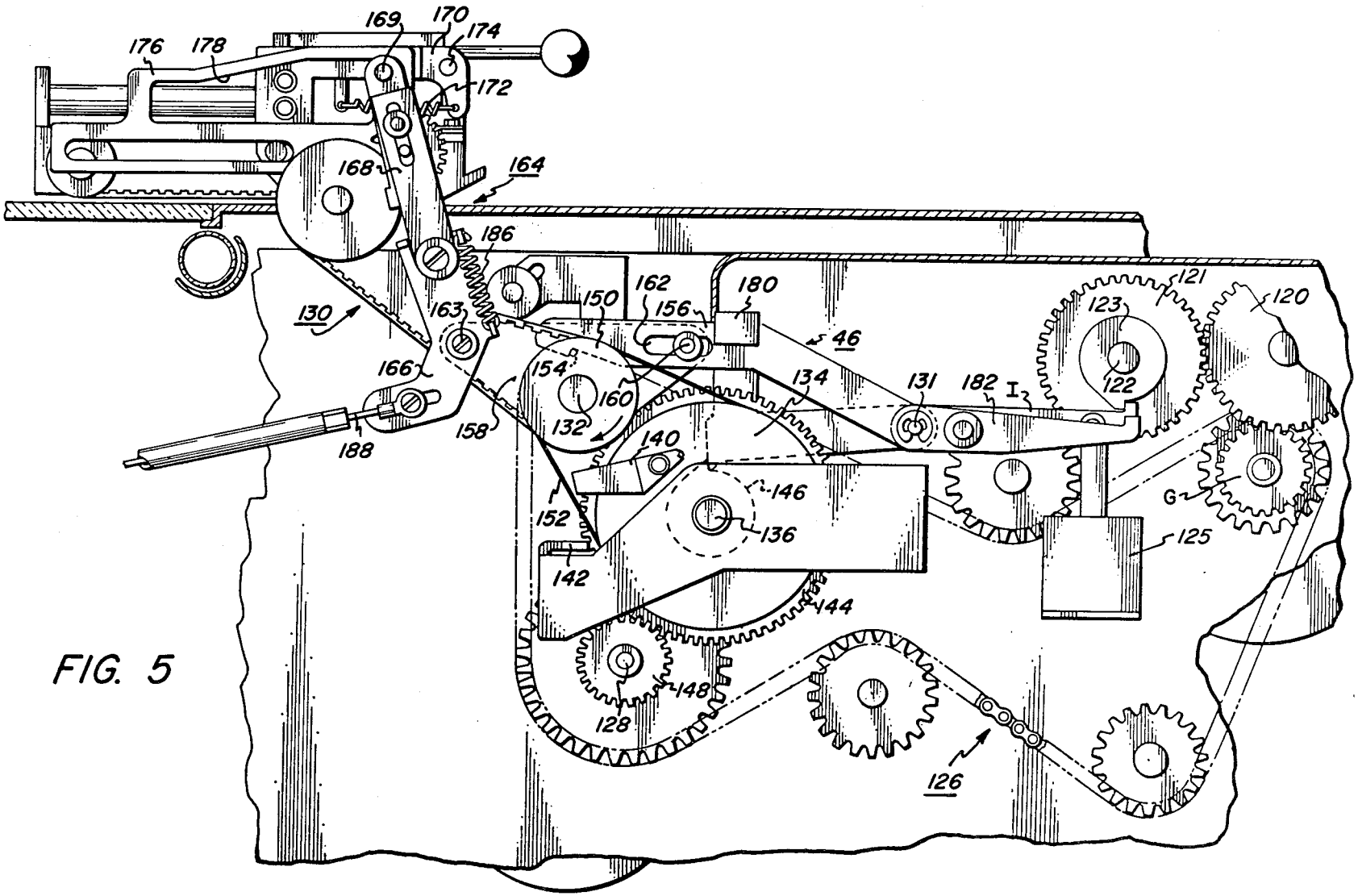
FIG. 5 is a partial front view of the apparatus of FIG. 1 providing a more detailed representation of the drives and interlock system.

FIG. is a partial side view of the drives apparatus of FIG. 5 as viewed from right to left.

Figure 7:
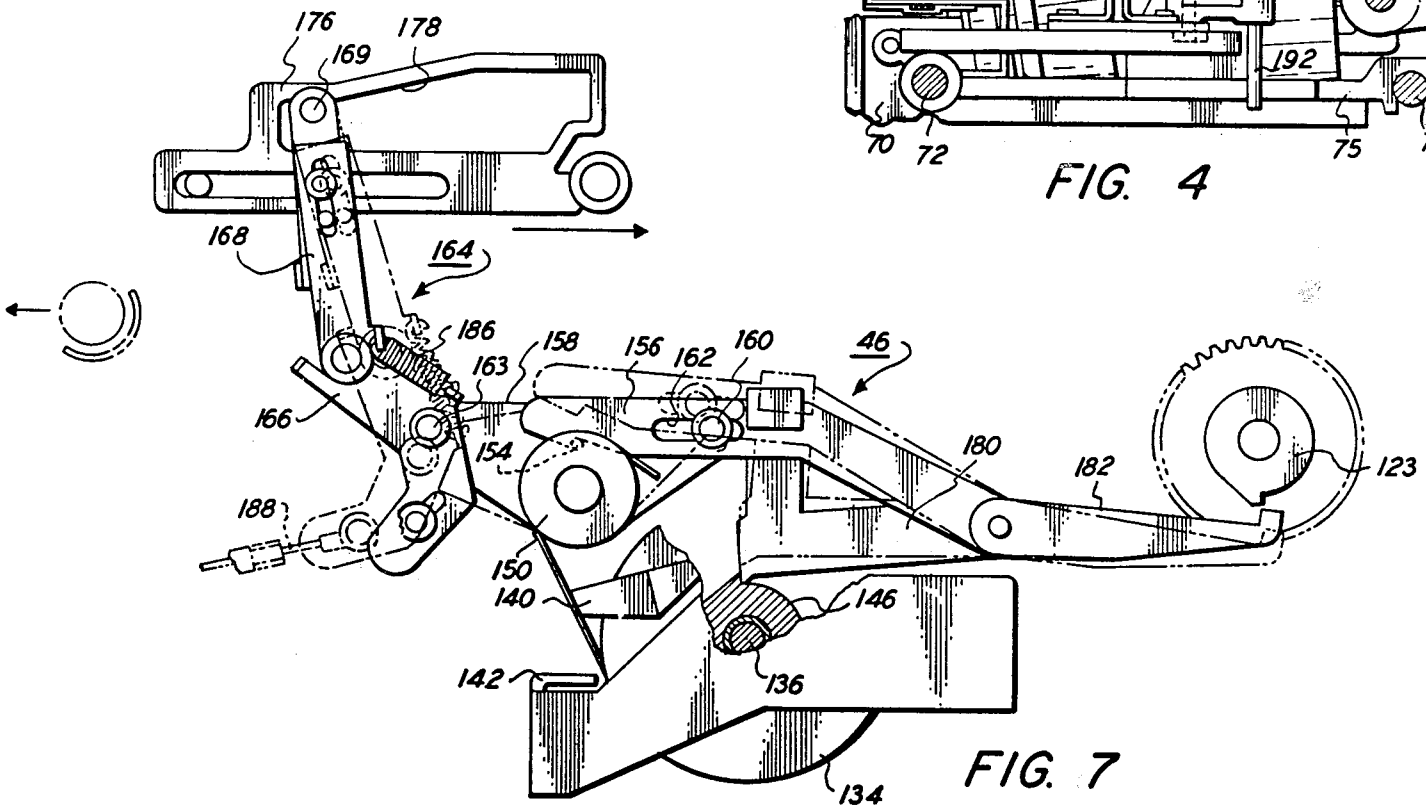

FIG. 7 is a partial front view of the apparatus of FIG. 5 illustrating operation of the interlocking apparatus.

Figure 8:
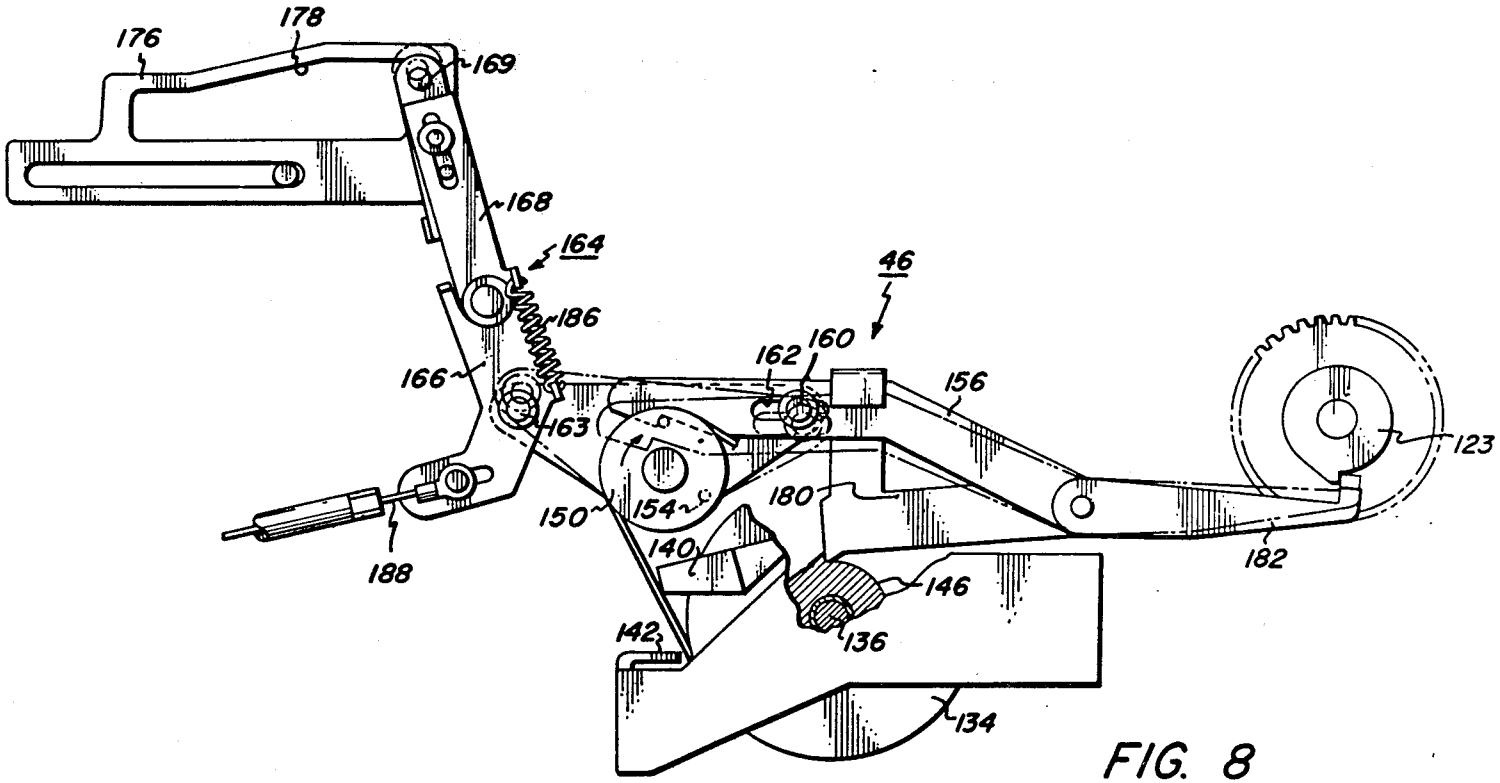

FIG. 8 is a partial front view of the apparatus of FIG. 5 illustrating the operation of the lock out apparatus in conversion to a moving document mode of operation.

Figure 1:
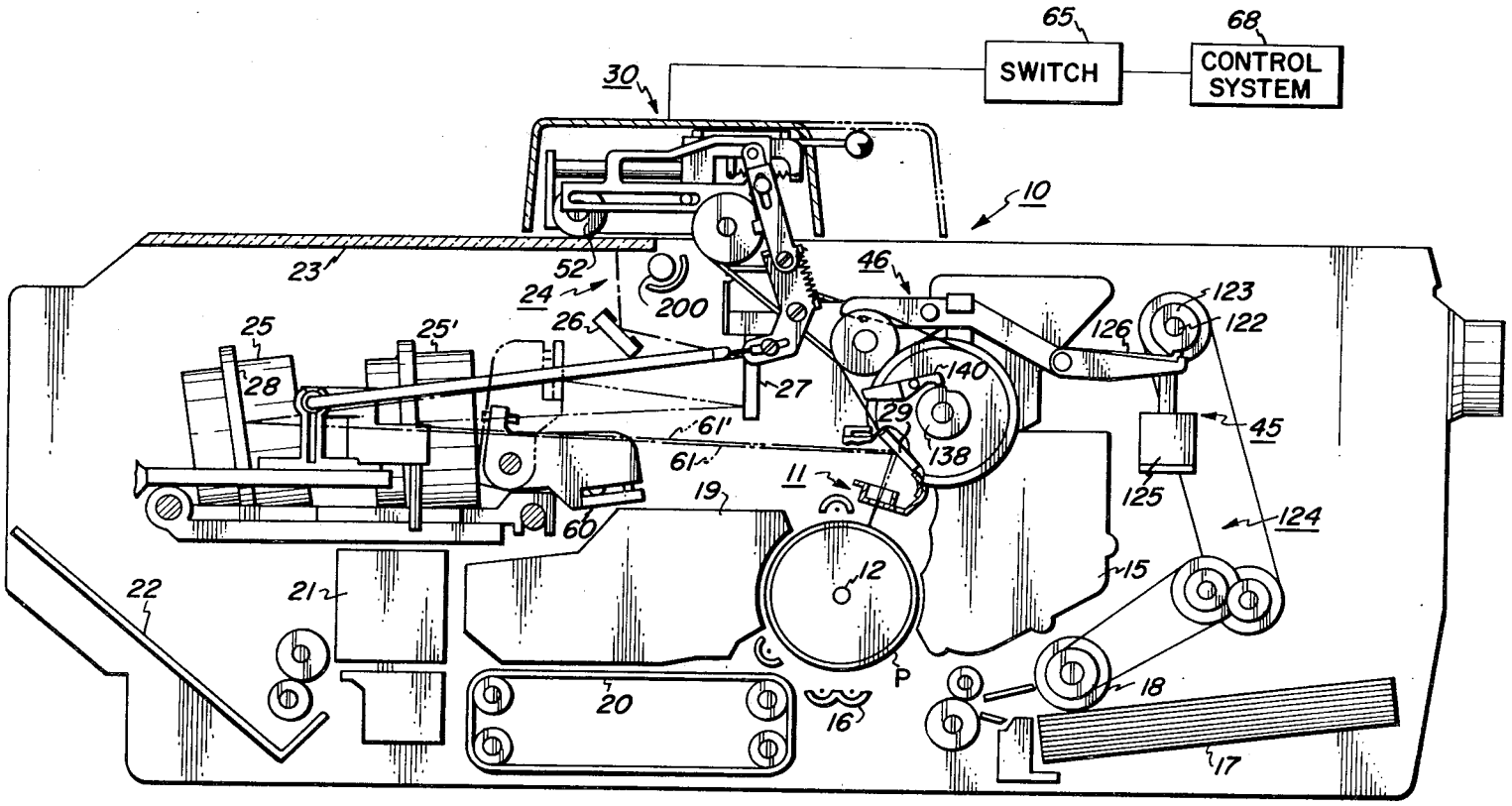
FIG. 1 is a schematic front view of a reproducing apparatus in accordance with one embodiment of the present invention.
Figure 9:
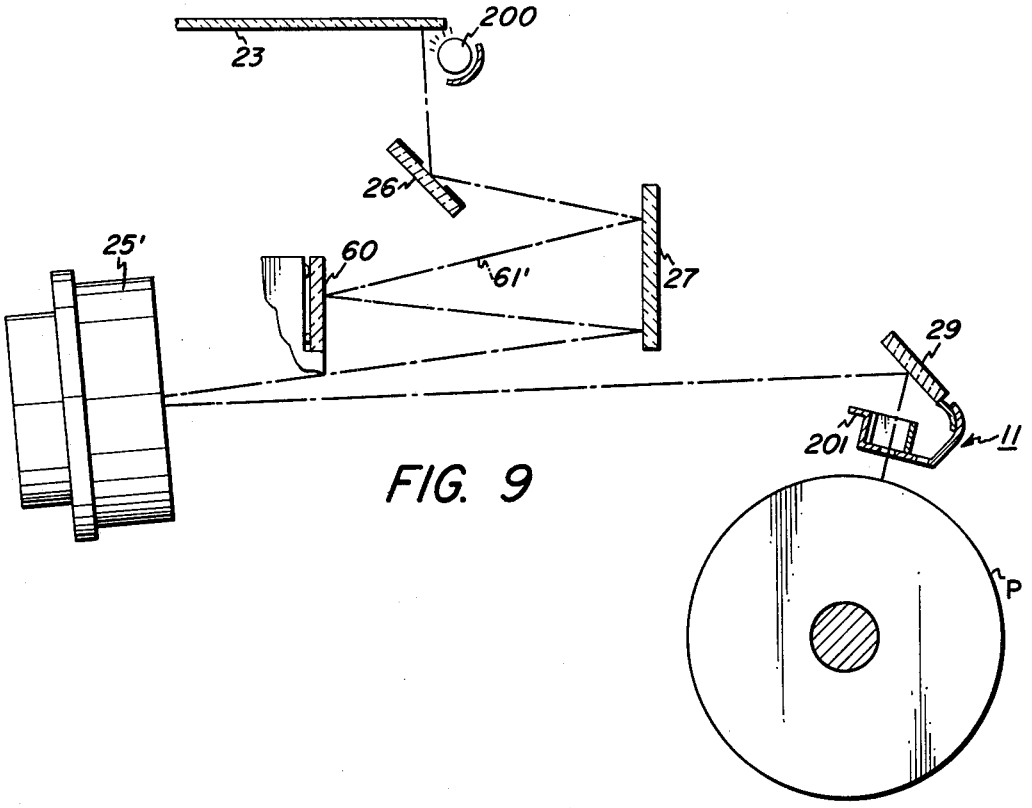

FIG. 9 is an enlarged view of the optical system of FIG. 1 in a reduction mode.

Figure 10:
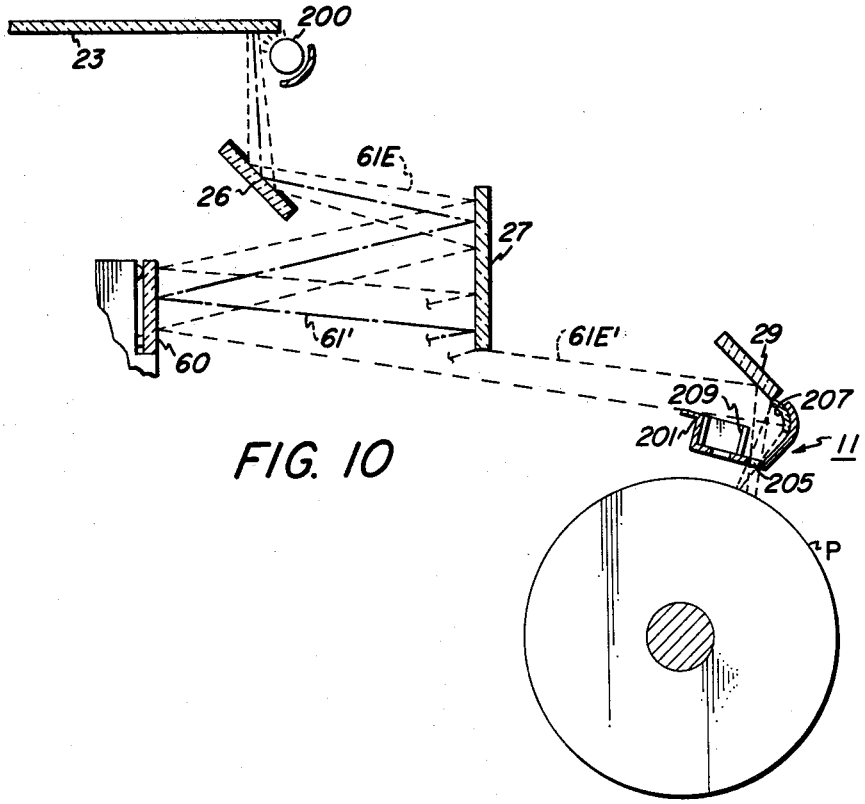

FIG. 10 is an enlarged view of the optical system of FIG. 1 showing the operative ray paths for providing marginal illumination in accordance with this invention.

Figure 11:
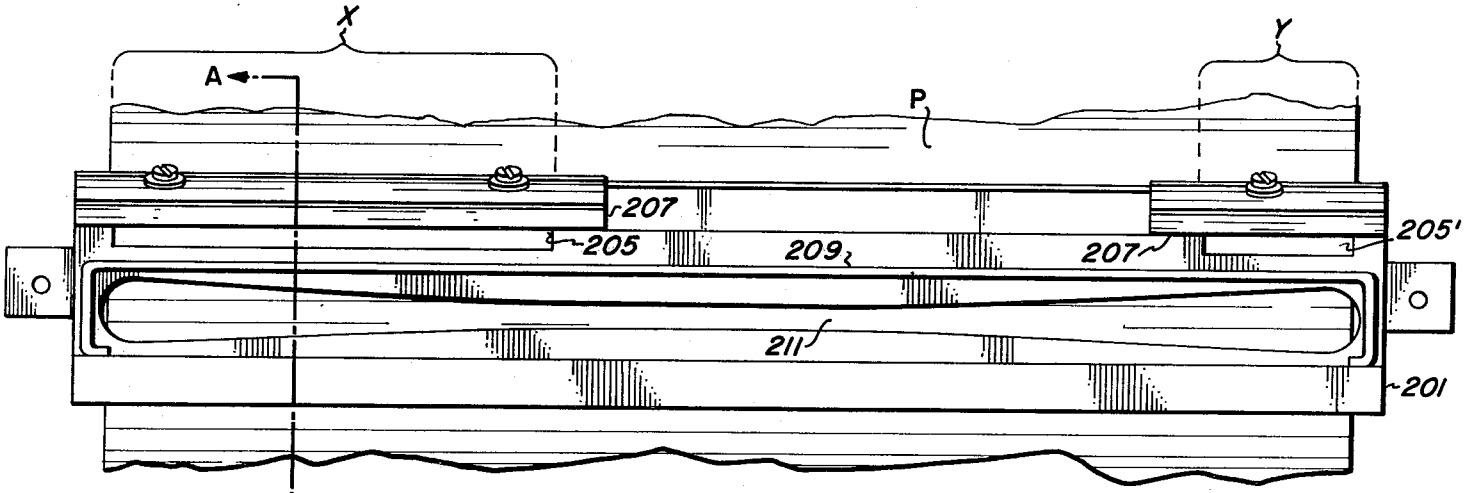

FIG. 11 is a top view of the exposure slit and marginal illumination device shown in FIG. 1.

Figure 12:
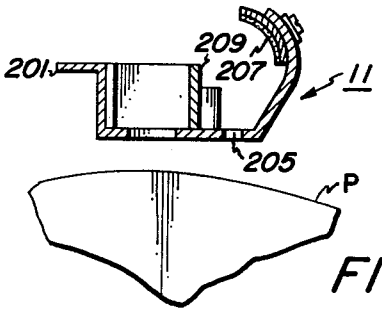

FIG. 12 is a cross-sectional view of the device of FIG. 11 taken along the line A—A.

DETAILED DESCRIPTION OF THE PREFERRED EMBODIMENTS

In the back ground of this invention there has been set out a number of patents dealing with reproducing apparatuses adapted to function in one or more modes of operation. Some of the apparatuses are capable of imaging from a moving or a stationary document and some of the apparatuses are capable of making copies in a variety of selected magnifications including reductions.

When one attempts to combine these modes of operation in a single reproducing apparatus of a fairly compact nature significant problems arise because of the limited space available in the optical cavity of the machine.

In accordance with a preferred embodiment of the present invention a multi-mode reproducing apparatus is provided having an extremely compact optical system which provides both moving and stationary original exposure and the associated advantages of each, as well as at least one mode of reduction by moving original exposure. The apparatus which will be described preferably features a unique optical system which enables the overall combination of modes of operation. The preferred optical system includes a marginal illumination system of this invention for erasing undesired non-image bearing portions of a photosensitive imaging member.

In order to properly describe the marginal illumination apparatus of this invention a description of a reproducing machine with which it can be employed follows.

Referring now to FIG. 1, there is shown by way of example an electrostatographic reproducing machine 10 which incorporates the exposure slit apparatus 11 of the present invention. The reproducing machine 10 depicted in FIG. 1 illustrates the various components utilized therein for xerographically producing copies from an original. Although the apparatus of the present invention is particularly well adapted for use in an automatic xerographic reproducing machine 10, it should become evident from the following description that it is equally well suited for use in a wide variety of electrostatographic systems and is not necessarily limited in its application to the particular embodiment shown herein.

Basically, the xerographic processor includes a rotatably mounted photoconductive drum P which is supported upon a horizontally extended shaft 12. The drum is driven in the direction indicated whereby its photoconductive surface is caused to pass sequentially through a series of xerographic processing stations.

The practive of xerography is well-known in the art, and is the subject of numerous patents and texts, including *Electrophotography* by Schaffert, published in 1965, and *Xerography and Related Processes,* by Dessauer and Clark, published in 1965. Therefore, the various processing steps involved will be briefly explained below in reference to FIG. 1. Initially, the photoconductive drum surface is uniformly charged by means of a corona generator 13 positioned within a charging station located at approximately the 12 o'clock drum position. The charged drum surface is then advanced into an imaging station 14 wherein a flowing light image of an original document to be reproduced in projected onto the charged drum surface thus recording on the drum a latent electrostatic image containing the original input scene information. Next, subsequent to the exposure step in the direction of drum rotation is a developing station 15 wherein the latent electrostatic image is rendered visible by applying an electroscopic marking powder (toner) to the photoreceptor surface in a manner well known and used in the art. The now visible image is then forwarded into a transfer station 16 wherein a sheet of final support material is brought into overlying moving contact with the toner image and the image transferred from the plate to the support sheet by means of a second corona generator 16.

In operation, a supply of cut sheets are supported within the machine by means of a paper cassette 17. A pair of feed rollers 18 are arranged to operatively engage the uppermost sheet in the cassette so as to first separate the top sheet from the remainder of the stack and then advance the sheet into the transfer station in synchronous moving relationship to the developed image on the photoconductive plate surface. The motion of the feed rollers is coordinated with that of the rotating drum surface, as well as the other machine components through the main drive system whereby the support sheet is introduced into the transfer station in proper registration with the developed toner image supported on the xerographic plate. For further information concerning this type of sheet feeding mechanism, reference may be had to U.S. Pat. No. 3,731,915 to Guenther.

After transfer, but prior to the reintroduction of the imaged portion of the drum into the charging station, the plate surface is passed through a cleaning station 19 wherein the residual toner remaining on the plate surface is removed. The removed toner particles are collected within a container where they are stored subject to periodic removal from the machine.

Upon completion of the image transfer operation, the toner bearing support sheet is stripped from the drum surface and placed upon a moving vacuum transport 20 which serves to advance the support sheet into a thermal fusing station 21 wherein the toner image is permanently fixed to the sheet. The copy sheet with the fused image thereon is forwarded from the fuser into a collecting tray 22 where the sheet is held until such time as the operator has occasion to remove it from the machine.

Normally, when the copier is operated in a conventional mode, the original document to be reproduced is placed image side down upon a horizontal transparent viewing platen 23 and the stationary original then scanned by means of the moving optical system 24. The scanning system 24 fundamentally consists of a lens 25 positioned below the right hand margin of the platen as viewed in FIG. 1, and a pair of cooperating movable scanning mirrors 26 and 27. The lens is basically a half-lens objective having a reflecting surface 28 at the top position to simulate a full lens system. The two mirrors are slidably supported between a pair of parallel horizontally aligned guide rails (not shown). For a further description and greater details concerning this type of optical scanning system reference is had to U.S. Pat. No. 3,832,057 to Shogren.

In practice, mirror 26, herein referred to as the full rate scan mirror, is caused to move from a home position, directly below the left hand margin of the platen to an end of scan position below the opposite margin of the platen. The rate of travel of the scan mirror is snychronized to the peripheral speed of the rotating xerographic drum surface P. The second mirror 27 is simultaneously caused to move in the same direction as the scanning mirror at half the scanning rate. As the two mirrors sweep across the platen surface, an image of each incremental area thereon viewed by the scanning mirror is reflected towards the second mirror which, in turn, redirects the image back to the half lens system. The reflecting surface, positioned at the lens stop position, reverses the entering light rays and redirects the light rays back towards a stationary mirror 29 positioned directly above the drum surface at the exposure station 14. In this manner a flowing light image containing the original input scene information is focused upon the charged photoconductive plate.

A wind up spring (not shown) is provided to restore the moving mirrors to a start of scan condition.

The copying apparatus 10 shown in FIG. 1 is provided with a document feeder 30. The document feeder 30 is movable between a first stored position adjacent to the viewing platen 23 and a second operative position over the platen surface. Commensurate with the positioning of the feeder assembly over the platen, the moving optical system 24 is locked in a position to view documents as they are advanced by the document feeder over the platen and record a flowing light image of the input information upon the moving photoconductive plate surface P.

Figure 2:
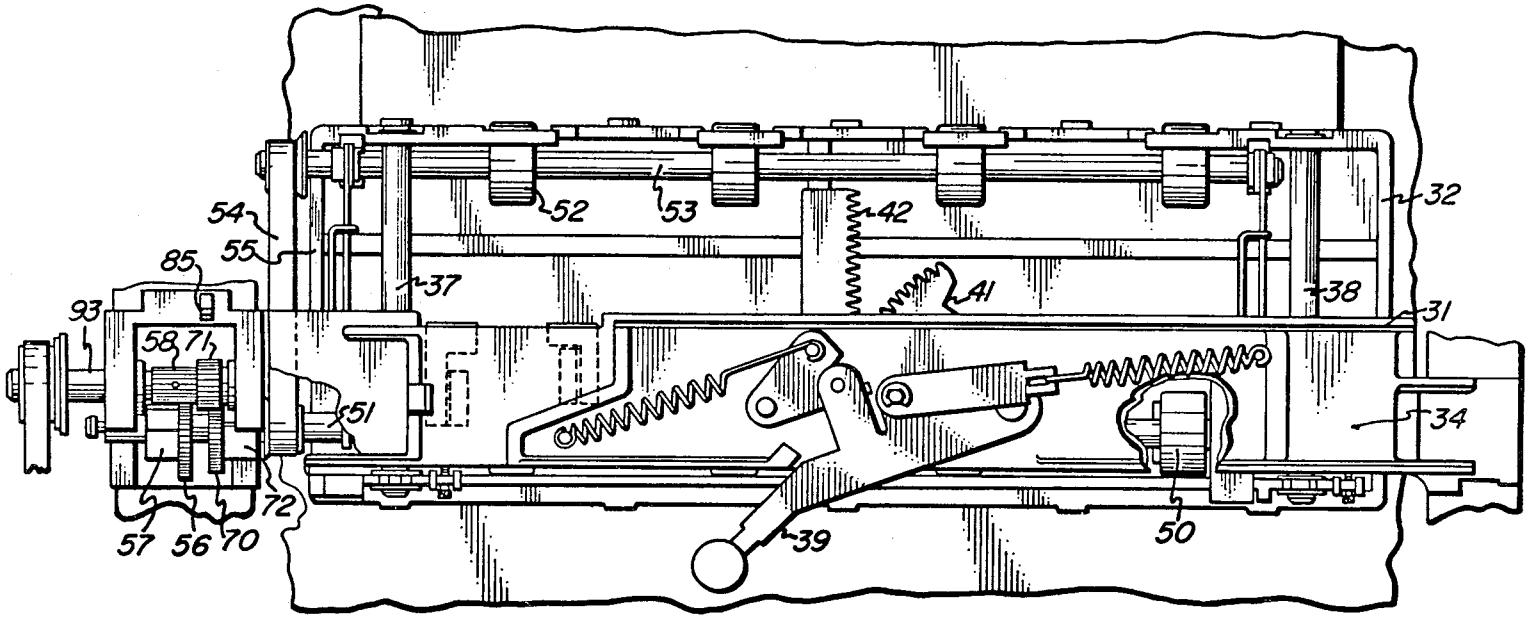
FIG. 2 is a partial top view of the apparatus of FIG. 1 showing the document feeder with the cover removed.
Figure 3:
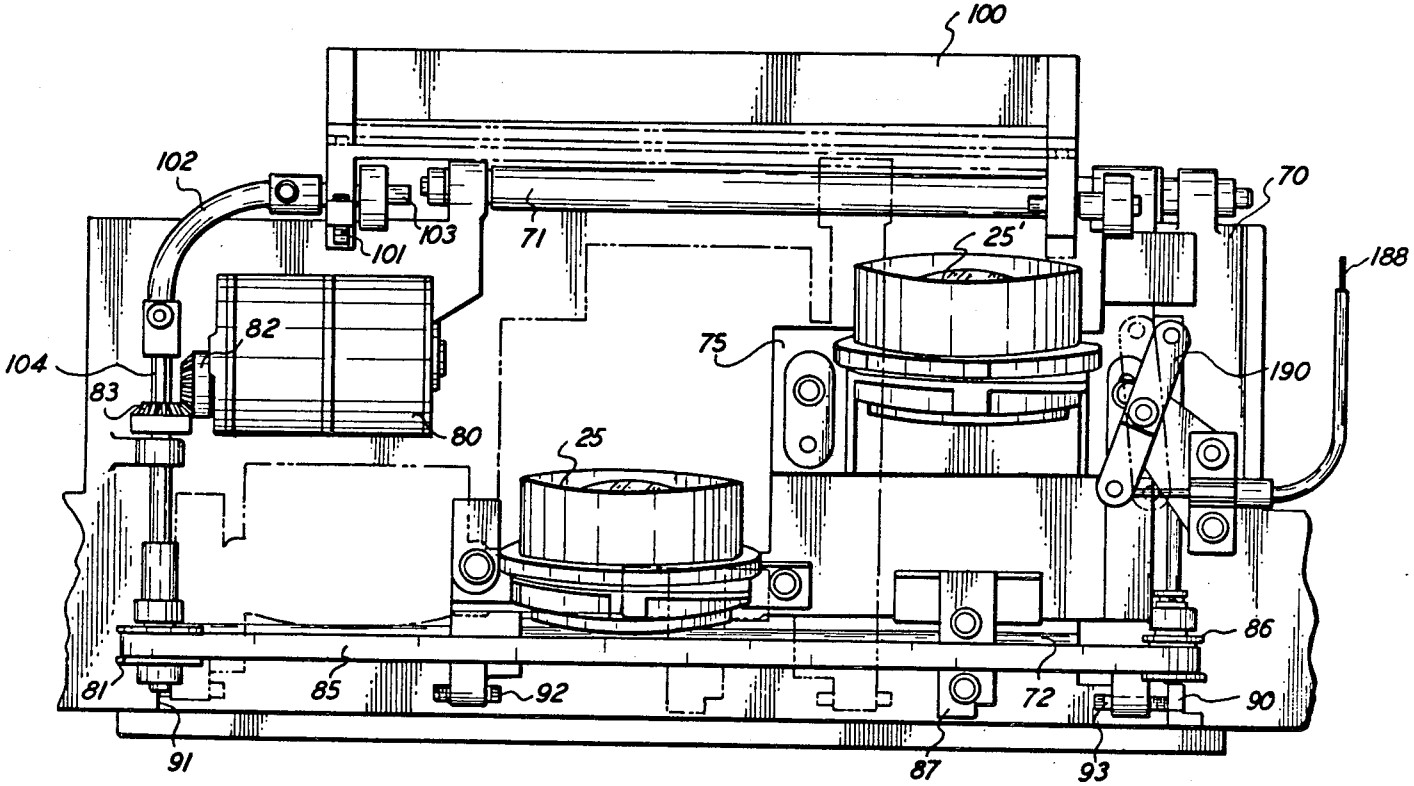
FIG. 3 is a partial top view showing the magnification changing apparatus for the optical system of the reproducing apparatus.

Referring now more specifically to FIGS. 1 and 2, there is shown the document feeding mechanism 30 associated with the instant invention. During normal operations, that is, when the moving optics are utilized to provide a flowing light image of the stationary original, the document feeding assembly is maintained in a stored position (as depicted by the phantom lines shown in FIG. 1) to expose the entire platen surface area and thus provide a maximum working area for the operator.

To initiate the moving document mode of operation, the machine operator simply advances the document feeding assembly 30 from the stored position to a document feeding position with the feeding assembly extending over the left hand margin of the platen surface. Fundamentally, the document feeding mechanism is made up of two main sections which include a stationary support bridge, generally referenced 31, and a movable feed roller support section, generally referenced 32. The bridge 31 is made up of two vertically extending end support members which are securely anchored in the machine frame and upon which is secured a horizontal span 34. The feed roller support section 32 is slidably suspended from the horizontally extended span 34 by means of a pair of parallel aligned rod-like guide rails 37 and 38 which are slidably supported in bearings (not shown) affixed to the underside of the bridge span. The document feed roll assembly is thus suspended from the span so that it can be freely moved back and forth from the home or stored position adjacent to the platen 23 and an extended position over the left hand margin of the platen surface.

In practice, at the start of the moving document handling conversion cycle, the machine operator grasps a lever arm 39 mounted on top of the bridge span and rotates the arm in a clockwise direction as shown in FIG. 2. The lever arm is operatively connected to segmented pinion 41 which meshes with a rack 42 secured to the feed roller assembly 32. Movement of the arm in a clockwise direction causes the movable feed roller assembly to be advanced toward the fully extended or operative position. Rotation of the arm in the opposite direction produces the opposite result.

Manually moving the feed roller support assembly 32 to the extended position also physically closes the contacts of a large document mode switch (not shown) causing a signal to be sent to the main machine drive motor (not shown) actuating the motor. At the same time, a signal is also sent to the machine logic control system placing the machine in a single copy mode of operation. This latter step is required in order to move the optical system from its normal rest position, which is the start of scan position at the left hand end of the platen surface, to the end of scan position beneath the now fully extended feed roll assembly. However, during this initial conversion phase, no original is actually being processed and there is, therefore, no need to feed copy sheets through the copier. In point of fact, feeding a copy sheet during the conversion phase would have a deleterious effect on the various machine components as well as confusing the machine programming and registering system. To prevent this occurrence, feed inhibiting means 45, as shown in FIG. 1, are provided for inhibiting the action of the paper feeder during the period when the machine is being converted to the moving document mode of operation. Means 46 are provided for locking the optics at the end of scan position during the moving original mode of operation. Means 46 comprise a lock-out mechanism which serves to both uncouple the optics drive shaft from the main drive system and hold the optics rigidly in a fixed position for viewing moving documents subsequently advanced through the document feeding assembly 30.

Further details of the lock-out means 45 will be presented later. An alternative feed inhibitor means and lock-out means which could be employed are described in U.S. Pat. No. 3,877,804 to Hoppner.

The movable document feed roller support section 32 of the document feeder assembly is provided with two sets of co-axially aligned rollers comprising a first set of drive rollers 50 mounted upon shaft 51 and a second set of hold down drive rollers 52 mounted upon shaft 53. The two roller support shafts are connected by means of a timing belt 54 whereby each set of rollers is adapted to turn in coordination with the other set of rollers. Shaft 51 is arranged to extend beyond the end wall 55 of the movable document feeder roll support section 32 and has a gear 56 rotatably supported thereabout by normally engaged wrap spring clutch 57. In operation gear 56 is adapted to move into and out of meshing contact with the stationary driven gear 58 as the document feed roll section is moved between its stored and fully extended position. When placed in a fully extended position, as shown in FIG. 2, the gear 56 meshes with gear 58 thus causing both the document feed rollers 50 and the hold down rollers 52 to be rotated. Directly below the stationary bridge and adjacent to the platen margin are a set of pinch rollers 59 (not shown) which are rotatably supported in the machine frame. The pinch rollers are arranged in the machine frame so as to coact with the feed rollers 50 when the document feeder 30 is in the operative position so as to advance a document introduced therebetween. In operation, the document is moved past the viewing domain of the now fixed optical assembly 24 and then into the pinch between the hold down rollers 52 and the platen 23 surface. The hold down rollers 52 serve to hold the document in sliding contact with the platen surface as the original is being moved past the optics and to feed the document after it leaves the pinch of rolls 50 and 59.

The rolls 50 and 52 in the feeder 11 shown are continuously driven during machine operation even when no sheet is being fed.

The machine which has been discussed thus far is similar in many respects to the aforenoted Xerox 3100 LDC copier. It is capable of operating in a number of modes including a scanning mode wherein a stationary original is scanned by the moving optical system 24 as well as a moving original mode wherein the original itself is moved in synchronism with the peripheral velocity of the drum and the optical system is held stationary. This latter approach is useful only in a single copy mode in the apparatus described; however, it facilitates the copying of originals having a size larger than the platen.

In accordance with the present invention yet another mode of operation may be provided for a reproducing machine. This additional mode of operation comprises a reduction mode wherein the image on the original is reduced in size by the optical system for projection onto the photosensitive surface whereby the image which is transferred to the sheet of final support material is similarly reduced in size. In accordance with the reproducing machine of this invention, the reduction mode is accomplished by a moving original exposure system.

For the reduction mode of operation it is necessary to operatively position alternative lens 25' to change the conjugate distance between the lens and the object or image planes. Further, it is necessary to advance the document past the fixed optics 24 at a velocity greater than the peripheral velocity of the drum P.

In accordance with a preferred embodiment of the present invention, the previously noted optical system of the Shogren patent is modified to provide for an alternative lens 25' which is translated to an operative position as lens 25 is translated to a stored position and for the insertion of an add mirror 60 into the optical path to change the platen 23 to lens conjugate. The optical system which is utilized herein is similar in many respects to that described in application Ser. No. 588,974, filed June 20, 1975, to Spinelli et al. The optical system of this embodiment provides in addition to the optical system of the Shogren patent an add reflector 60 which is selectively positionable into the optical path to combine with the half rate mirror 27 to form a reflection cavity and increase the object distance for magnification change. The alternative lens 25' is positioned relative to the optical path to adjust the conjugate distance. Of course, by the nature of a half (Catadioptric) lens 25 with its associated reflector 28 the optical path incident to the lens and reflected back through the lens is at some angle relative to the lens axis. Therefore, a magnification change necessitates repositioning of the original lens 25 or positioning an alternative lens to take into account the divergence of the lens axis and optical path. The insertion of the add reflector 60 displaces the optical path 61 to 61' and, therefore, the lens 25' with its lens reflector 28 is positioned to satisfy conjugate distance requirements and to be centered on the optical (principal ray) path 61'.

It is a unique feature of this optical system that the add mirror 60 does not form part of the scanning optical arrangement so that no adjustment is necessitated in the drives for the scanning mirrors irrespective of which magnification mode is selected. The provision of an add mirror 60 independent of the scanning optical system, which may be positioned in and out of the optical ray path of the scanning optical system provides a further advantage by reducing the mass of the scanning mirror assembly as compared with the prior art.

In order to obtain varying projected image magnifications by moving original exposure, it is necessary to advance the document past the optical viewing system at a velocity which varies depending upon the magnification which is selected. Various drive mechanisms are known which would enable the document feeder 30 to be driven selectively at one of a plurality of desired speeds corresponding to the given magnifications or minification selections. See, for example, those described in the Hoppner et al. [2] application and in U.S. Pat. No. 3,320,275 to Hewes et al.

The magnification changing mechanism 11 in accordance with the present invention includes a second lens 25' which is arranged for movement between a first stored position where it is inoperative and a second position where it is operative to project an image of the document onto the photosensitive surface P at a projected image magnification different than that provided by the lens 25. In its operative position the lens 25' is positioned forward of and laterally of the lens 25. It is necessary when employing the mode of operation utilizing lens 25 to store lens 25' at a position wherein it is outside the field of the optical ray path 61.

Commensurate with the positioning of the second lens 25' in its operative position an add reflector 60 is inserted in the optical ray path 61 to redirect it to 61' and to form a reflection cavity with the half-rate mirror 27 in order to change the conjugate relationship on the object side of the lens. The first lens 25 is translated out of the field of the optical ray path 61' so that it is inoperative when the lens 25' and add mirror 60 are operatively positioned.

A means for conditioning the apparatus 10 for moving original exposure has already been described. To condition the apparatus 10 for moving original exposure at a desired projected image magnification, a switch 65 as in FIG. 1 is provided to appropriately signal the machine control system 68 to condition the apparatus 10 in the first mode of moving original exposure which employs the stationary lens 25 and the fixed scanning mirrors 26 and 27 in accordance with the 3100 LDC approach or in the alternative mode of moving original exposure wherein lens 25' is translated from its stored position to its operative position and the lens 26 is translated to its stored position. The add mirror is pivoted from its stored position (shown in solid lines) out of the optical path 61 to its operative position (shown in phantom). The machine control system does not form part of the present invention and any desired system could be employed.

Referring now to FIGS. 1 - 4, the magnification changing mechanism 11 in accordance with the present invention will be described in greater detail. The magnification changing mechanism 11 in accordance with a preferred embodiment includes a frame 70. A pair of parallel spaced apart guide rails 71 and 72 are rigidly supported in the frame and a lens carriage 75 supporting lenses 25 and 25' is slidingly supported upon the guide rails for movement between the base mode position shown in solid lines wherein the lens 25 is positioned in the optical ray path 61 and the reduction position as outlined in phantom in FIG. 3 wherein the lens 25' is positioned in the optical ray path 61'. Each lens 25 or 25' in its stored or inoperative position is positiond outside the domain of the operative optical ray path 61 or 61'.

Each lens orientation is controlled by the way in which it is positioned on the lens carriage 75. Therefore, if it is desired to tilt the second lens 25' as compared to the orientation of the first lens 25 to avoid vignetting as in the aforenoted Hoppner et al. [2] application, the second lens is supported in the tilted orientation on the lens carriage. Similarly, the position of the lenses vertically upwardly or downwardly and laterally of the machine may be set as desired by appropriately positioning the lenses on the lens carriage 75 and by appropriately controlling the lateral movement of the lens carriage.

A substantial advantage of this apparatus 11 over other approaches is the fact that the lateral displacement of the lenses 25 and 25' in a generally horizontal direction may be set as desired in order to obtain any desired copy image registration position on the resulting copy sheet and can be easily changed. The use of a two lens arrangement as in this invention offers great flexibility in adjusting the copy image registration on the copy sheet. Some adjustment of conjugate can also be obtained by adjusting the position of the lens on the lens carriage longitudinally of the optical path. The use of two lenses also allows the focal length to be varied between the lenses to provide additional flexibility for magnification change. The use of two lenses 25 and 25' of the same focal length is preferred, however in view of the economy associated with such commonality.

The lens carriage 75 is driven by a motor 80. The motor 80 imparts motion to the lens carriage drive pulley 81 by means of the bevel gears 82 and 83. The drive pulley 81 is operatively connected to the lens carriage 75 by means of a timing belt 85 which is supported about the drive pulley at one side and about an idler pulley 86 at the other side. The timing belt is connected to the carriage 75 by means of a cantilever spring and clamp arrangement 87 so that the carriage 75 may be over-driven against stops 90 and 91 which are arranged at the respective end of travel positions. Carriage supported adjustable set screws 92 and 93 which act against the stops 90 and 91 are provided to adjust the operative positions of the carriage for base mode and reduction copying.

Upon selection of a desired mode of moving original exposure by means of a selector switch 65 if the lens carriage 75 is not already positioned in the desired position for that mode the carriage is translated until it engages the opposing stop member. Upon engaging the stop member the carriage is held at the desired position and a limit switch (not shown) is actuated, which by means of any desired circuitry serves to stop the motor 80 after a desired interval of over-drive so that the carriage is sufficiently biased against the stop so that the lenses will not be subject to shifting during operation which could adversely affect image quality. Similarly, when the alternate magnification mode of exposure is selected, the lens carriage 75 is translated in the opposing direction until it reaches the opposing stop member. Upon engaging the opposing stop member it actuates the opposing limit switch (not shown) which serves to stop the motor after a predetermined interval of over-drive. The cantilever spring and clamp arrangement allows the drive pulley 81 to continue to rotate and sightly advance the timing belt even though the carriage 75 has stopped.

The add mirror 60 is mounted on a pivoting carriage 100. The carriage is shown in its inoperative position in solid lines and in its operative position in phantom. An adjustable stop 101 is provided for accurately controlling the position of the add mirror when the carriage is in its operative position. The add mirror 60 is driven to its operative position or vice versa simultaneously with the positioning of the lens carriage. A flexible drive coupling 102 is secured at one end to a shaft 103 pinned to mirror carriage 100 and journaled in frame 70. The other end of the coupling 102 is secured to the shaft 104 supporting bevel gear 83. The flexible coupling may comprise a torsion spring wrapped about an inner cable or reverse wound torsion spring. The coupling 102 allows the mirror to be over-driven against the stop 101 so that it is biased in its operative position.

The drive arrangement described allows a single drive motor 80 to advance both the lens carriage 75 and the mirror carriage 100 between their respective operating positions. Since both elements are driven simultaneously the position of either the lens carriage or the mirror carriage can be utilized to sense the position of the other elements.

The interlocking mechanism is tied into the lock-out apparatus 46 of the machine, which is similar in most respects to the lock-out system utilized in the 3100 LDC machine. The particular lock-out mechanism 46 to be described differs to some extent from that described in the Hoppner et al. [1] patent in that some simplification has been made to reduce the number of levers in the linkage and eliminate one of the solenoids originally employed.

The drives of the machine are powered from the main drive motor through gear 120. Drives for the paper feeder are taken from the main drive 120 meshing with gear 121 supported about shaft 122 by means of wrap spring clutch 123. As shown in FIG. 1, a paper feed drive system 124 including appropriate chains and sprockets are utilized to impart drive from shaft 122 to the paper feed roll 18. A solenoid 125 and pivoting lever I are employed for controlling the operation of the paper feeder during normal machine operation. Paper feeding is controlled by actuation and deactuation of the solenoid by the machine control system at an appropriately timed interval in the copying cycle. The lever I is shown in FIGS. 1 and 5 in a position engaging the detent on the clutch collar to disengage the clutch and thereby the drives from the paper feeder.

Figure 6:
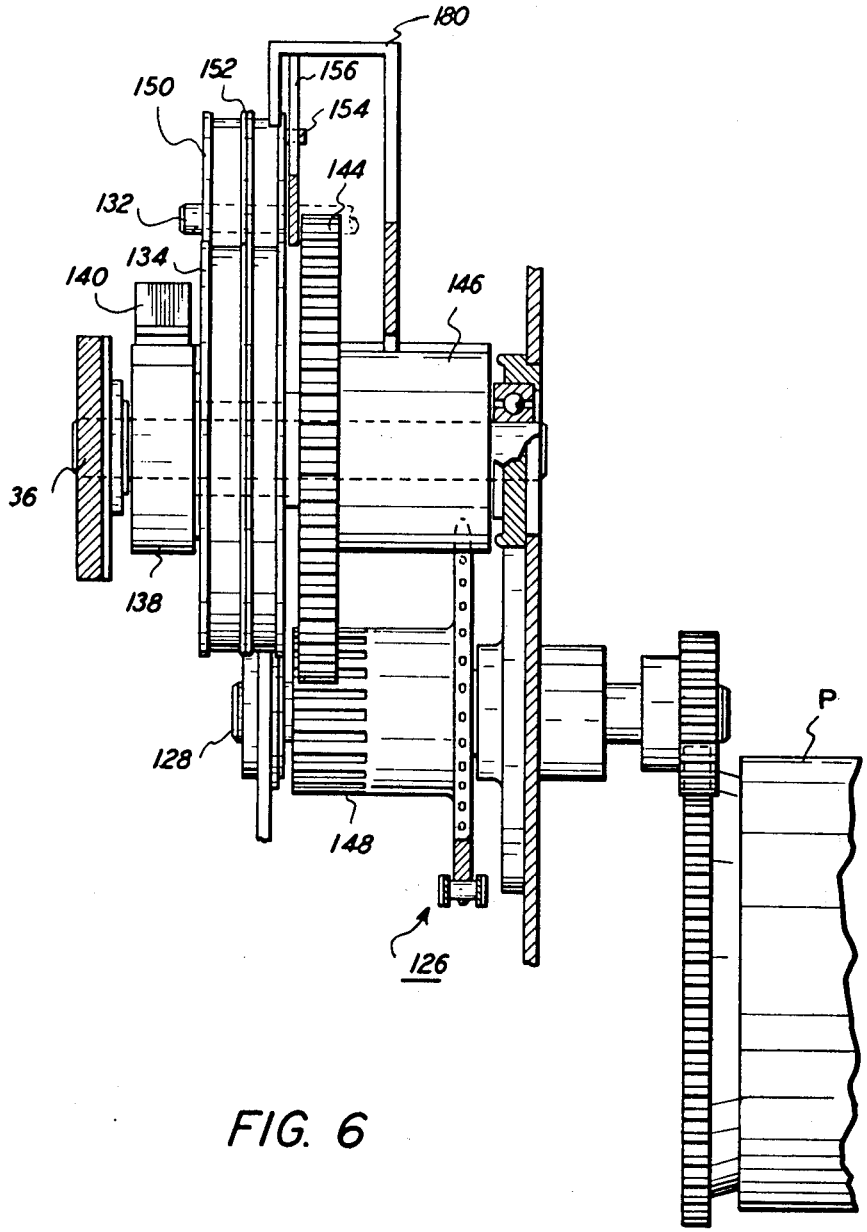

Reference will now be had to the drives for the optical system and document feeder using FIGS. 1, 5, and 6. Those systems are connected to the main drive gear 120 through gear G and the main drive chain and sprockets 126. The photoreceptor drum P is driven of the main drive chain via the shaft 128. The drives to the document feeder rolls are provided by a timing belt and pulley arrangement 130. The timing belt is continuously driven of the main drive chain 126 via a combination sprocket and lower belt pulley (not shown) which idle on optics drive shaft 132. It is apparent, therefore, that the rotational speed of the rolls 50 and 52 is coordinated to the rotational speed of the drum P and synchronized therewith by means of the common drive chain arrangement 126. The document feeder rolls are, of course, only driven when the document feeder 30 is in its operative position over the platen 23. When it is in its stored position, the gears 56 and 58 are separated so that no drive is imparted to the rolls.

Drive input to the scanning optical system 24 is imparted by means of a scan drive pulley 134 rotatably supported about shaft 136. The scan drive pulley for scanning operation is selectively drivingly engaged to the shaft 136 by means of a drive collar 138 and pawl 140 arrangement as in FIG. 1. A lip 142 associated with the machine frame, as in FIG. 5, is arranged to disengage the scan pawl from the scan collar to allow the optics to fly-back. Scanning drive shaft 136 is driven by means of gear 144 which is mounted thereon through clutch 146. Gear 144 meshes with a gear 148 pinned to shaft 128 to provide a synchronized drive from the main drive chain 126. Shaft 136 is disengaged from the drives when appropriate by means of an extension (not shown) of solenoid operated lever I which engages the detent of clutch 146 when the lever is in the position as shown in FIG. 5.

Therefore, to provide paper feeding and scanning of the optical system the solenoid 125 would move the lever I clockwise about its pivot to allow the clutches 123 and 146 to engage the gears 121 and 144 to their respective shafts 122 and 136.

Further details of the scanning drive system can be obtained by reference to the above-noted Shogren patent.

The scan drive pulley 134 is connected to the optics drive shaft 132 by an optics pulley 150 pinned to that shaft and cable 152 wrapped about both the scan drive pulley 134 and the optics scan pulley 150. When the mirrors 26 and 27 are moving toward their end of scan position, the optics scan pulley is moving in the direction of the arrow in FIG. 5.

The optics scan pulley includes a pin 154 which is arranged to be engaged by a lock-out lever 156 which locks the mirrors 26 and 27 at their end of scan position. Actuation of the lock-out lever 156 is provided by means of a pivoting plate 158 which is pivoted about the optics drive shaft 132. One end of the plate 158 includes a pin 160 which is arranged to ride in a slot 162 in the lock-out lever. The other end of the plate is pivotally secured by screw 162 to a document feeder connecting linkage 164. The connecting linkage 164 includes a first pivoting link 166 arranged to be pivoted about the screw 163. A second adjustable length link 168 is pivotally secured to the pivoting link 166 at one end and pivotally secured at its other end by a follower pin 169 to an "L" shaped biasing link 170. The link 170 is biased by spring 172 to bias the linkage 164 in an upwardly direction. The biasing link 170 is pivotally supported about pin 174 which is secured to the stationary bridge 31 of the document feeder 30.

A plate-like cam 176 is secured to the moving carriage 32 of the document feeder 30. The top surface 178 of the slot in the cam comprises the cam surface and it is arranged to be engaged by the follower pin 169 which is biased thereagainst. The linkage 164 is thereby moved upwardly and downwardly by the action of the cam surface 178 against the follower pin 169 as the movable carriage 32 moves on and off the platen 23. This controls the actuation of the lock-out lever.

When the document feeder 30 is in its operative position over the platen 23 and the machine 10 is conditioned for moving original exposure, it is not desired to continue to drive the scan drive pulley 134. Therefore, an auxillary scan drive disengagement lever 180 is provided which pivots about pin 131 so as to engage the detent collar on clutch 146 and disengage it during moving original exposure copy cycles. Actuation of the lever 180 is keyed to actuation of the scan lock-out lever 156 by means of a U-shaped top portion of the lever 150 which hooks over the scan lock-out lever. The scan drive disengagement lever 180 is arranged to pivot by gravity in and out of engagement with the clutch 146 depending on the position of the scan lock-out lever 156.

During the mode conversion cycle, that is, when the document feeder 30 is first placed over the platen 23, the machine operates as if a copy is being made so that the scanning mirrors 26 and 27 will scan to their end of scan position. During this period, however it is not desired to feed a sheet of paper. The lever I and solenoid actuator 125 are not affected during the conversion cycle to lock-out the paper feeder because they behave as if a copy is actually being made. Therefore, an auxillary lever 182 is employed which is actuated during the conversion cycle to inhibit the paper feeder by disengaging the clutch 123. The auxillary paper feed inhibiting lever 128 is secured to the optics lock-out lever 156, and they pivot about pin 131 as a unit.

Operation of the lock-out system will now be illustrated by reference to FIG. 7. When the document feeder 30 is in its inoperative position off the platen 23 the cam 176 and linkage 164 are arranged as shown in phantom. The linkage 164 has been pushed downwardly by the cam surface 178, thereby pivoting the pivoting plate 158 clockwise and causing the scan lock-out lever 156 to be raised off the optics scan pulley pin 154. In this position, the lock-out lever 156 is inoperative so that conventional scanning operation can take place. Since the lock-out lever has been raised up, the scan drive disengagement lever 180 is also raised up as shown in phantom so that the drive gear 144 is engaged through the clutch 146 to the shaft 136. When the lock-out lever 156 is in its uppermost position the auxillary paper feed inhibit lever 182 is disengaged from the paper feed clutch 123 and, therefore, paper feeding will be keyed to the operation of the solenoid actuated paper feed inhibiting lever I.

Upon movement of the document feeder 30 to its operative position over the platen 23 as shown in FIGS. 1 and 8, the document feeder connecting linkage 164 guided by the pin 169 riding against the cam surface 178 moves upwardly to pivot the pivoting plate 158 in the clockwise direction thereby dropping the lock-out lever 156 to the position shown in phantom. The optics scan pulley 150 will rotate in the direction of the arrow as the mirrors 26 and 27 are driven to their end of scan position. The optical scan pulley 150 actually makes more than one revolution so that the pin 154 engages the lock-out lever 156 on two occasions. The second time the pin 154 engages the lock-out lever 156, the scan pulley 150 stops at the end of scan position as shown in solid lines and is held there by the lock-out lever catching the pin.

The scan drive pulley is disengaged from the drive shaft through the operation of the lip 142 on the scan pawl 140. The detent of clutch 146 is then engaged by the scan drive disengagement lever 180 to disengage the gear from the machine drives.

As the lock-out lever is raised to its locking position as shown in solid lines in FIG. 8, the auxillary paper feed inhibiting lever 182 is disengaged from the paper feed clutch detent so that paper feeding for future copying cycles of the machine make take place in its normal timed sequence using the regular paper feed inhibiting lever 126 and solenoid 125 control.

Figure 4:
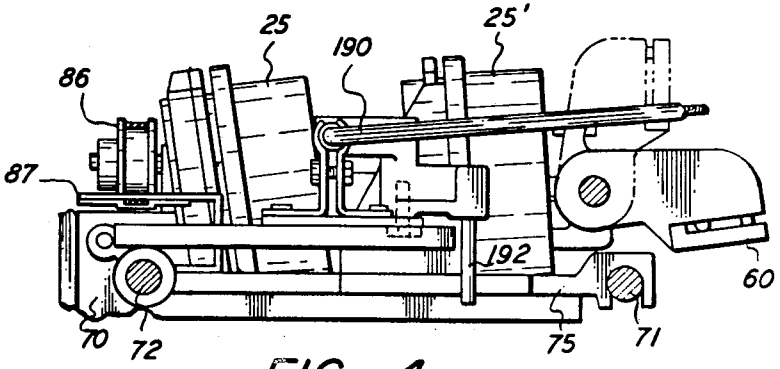
FIG. 4 is a partial side view of the apparatus of FIG. 3.

The lock-out system which has been described is similar in most respects to the one employed in commercially available 3100 LDC machines with the exception that the document feeder connecting linkage 164 is modified to make it collapsable to provide an interlock system. The pivoting connection between links 166 and 168 allows them to collapse which is a unique feature of the inter-lock system. A spring 186 connected between tabs on the upper and lower links 168 and 164 is arranged to bias the links towards their collapsed state which is shown in solid lines in FIG. 7. A cable 188 is connected between the lower link 166 and a pivoting sensing lever 190 supported by the optics frame 70. When the optical system is in the reduction mode the carriage 75 is in the position shown in phantom in FIG. 3. In this position the action of spring 186 would allow the upper and lower connecting links to be collapsed as shown in FIG. 7. The cable would then pull sensing lever 190 to the position shown in phantom. Referring to FIG. 4 as well, when the optical system is positioned in its base mode the carriage 75 is positioned as shown in solid lines and acts upon pin 192 secured to the sensing lever to pivot it to the position shown in solid lines in FIG. 3, and to thereby pull the cable taught. As the cable is pulled tight, the lower link is pivoted about pin 162 to straighten out the links 166 and 168.

The pivoting sensing lever 190 therefor senses the position of the lens carriage 75, and thereby the position of the mirror carriage 100. In the 1-X mode the mirror carriage is in its lowered position out of the optical ray path. It is important that the add mirror 60 be lowered before the scanning mirrors 26 and 27 are released to fly-back to their start of scan position. Otherwise it is likely as shown in FIG. 1, that the half rate mirror would crash into the add mirror. The use of the collapsing linkage 166 and 168 assures that the scanning mirrors 26 and 27 will not be released prior to the movement of the add mirror 60 to its inoperative position as shown in solid lines. This is the case even if the document feeder 30 is moved off of the platen before the optical system 24 has been conditioned for base mode copying.

If the machine 10 had been operated in a moving original mode of exposure other than one requiring reduction, then the linkage 164 would not be collapsed. The linkage is collapsable upon operation of the machine in a reduction mode and movement of the document feeder 30 off of the platen before the optical system has had an opportunity to condition itself back for base mode copying.

Referring now to FIGS. 1, and 9 through 12, a specific embodiment of the margin illumination apparatus 11 of this invention will be described in the context of the above-described reproducing apparatus 10.

The optical system 24 of the reproducing apparatus 10 includes lamp 20 which scans with the mirror 26 for purposes of illuminating the platen and the document supported thereon or advanced thereover. In accordance with the present invention it is desired to utilize the available light in the optical system which is derived from this lamp, in order to provide margin illumination for discharging the drum in at least one margin region prior to development. As above-noted it is highly desirable to discharge non-imaged margin areas of a photoconductive surface prior to development to avoid the print-out of black borders and to avoid overburdening the cleaning system of the machine. Prior art approaches have principally utilized additional illumination lamps and suitable masking arrangements for providing such margin illumination.

In accordance with the embodiment of the present invention which will be described, the available light margin illumination system 11 is operative only in a reduction mode of operation. In the normal or base modes of copying without optical reduction the available light margin illumination system of this invention is inoperative. This is highly desirable since erasing the side margins in those modes of operation could cause deletion of a portion of the desired image from the copy sheet.

This selective operation of the margin illumination system 11 is achieved in accordance with the present invention by utilizing the add mirror 60 to intercept a portion of the image rays 61' and to apply that portion of the image rays to the margin region X and Y without their passage through the lens 25'. Since the add mirror 60 is employed solely in the reduction magnification mode of operation keying the margin illumination system 11 operation off the interposition of the add mirror into the optical ray path 61 serves to provide a selective approach for the margin illumination.

Referring to FIG. 9, the optical apparatus 24 is shown in position for reduction mode copying. The opticl ray path 61' extends from the platen 23 to the photosensitive surface P of the drum. The image rays are received by the full rate mirror 26; reflected to the half-rate mirror 27; then to the add mirror 60; back to the half-rate mirror 27; then to the lens 25'; then to the drum mirror 29; and then to the photosensitive surface P through an appropriate illumination slit 201.

It has been found in accordance with the present invention that in addition to the ray path 61' as set forth in FIG. 9, an additional ray path for image rays is provided in the reduction mode as set forth in FIGS. 10–12. In FIG. 10, in addition to the principal ray, the image ray envelope or bundle 61E are reflected from the add mirror 60 to the half-rate mirror 27 and then back to the lens portion 61E' of the image ray envelope reflected from the add mirror passes below the bottom of the half-rate mirror and thereby escapes reflection to the lens. This partial envelope of image rays 61E' partially intercepts the drum mirror 29 which reflects it toward the photosensitive surface at a position adjacent the illumination slit opening.

The illumination slit 201 would normally block those rays from reaching the drum surface. However, in accordance with this invention at least one appropriately located slot 205 or 205' is provided in the base of the illumination slit 201 to allow passage of the image rays 61E' to the drum surface in the margin region.

Since the portion 61E' of the image ray envelope directed at the drum mirror 29 only partially intercepts that mirror an additional concave reflector 207 preferably having a cylindrical reflecting surface is provided for intercepting a further part of the image rays 61E' and for directing them through the slots 205 and 205' in the illumination slit 201 for application to the margins of the photosensitive surface P. The concave surface of the reflector 207 serves to concentrate these rays as shown.

In order to separate the image rays 61' from the lens 25' which are adapted to image-wise expose the surface P from those 61E' utilized for margin illumination a non-reflective baffle 209 is provided between the illumination slit 201 and the slots 205 and 205'.

It should be apparent that when the add mirror 60 is moved to its stored position as shown in solid lines in FIG. 1, the partial image ray bundle 61E' used for margin illumination is not formed so that margin illumination through the slots 205 and 205' does not occur for base magnification modes of copying. Therefore, the present system is totally selective and comes into operation only when the add mirror is in use.

Referring more specifically to FIG. 11 and 12, details of the illumination slit 201 carrying the margin illumination slots 205 and 205' are shown.

The base of the illumination slit shown in FIG. 11 is extended past the slit opening and serves as a mask for margin illumination. The mask includes two elongated slots 205 and 205' spaced from the elongated opening of the illumination slit and separated by the aforenoted baffle 209. The slots 205 and 205' are arranged to illuminate side margins of the photosensitive surface P on both ends of that surface. Such an approach would normally be required for a center registered system wherein the image is always centered on the photosensitive drum. It would also be required in an edge registered system such as the one described above wherein the sheets are registered against one edge if the copy image registration edge is not made coincident on the copy sheet for base mode and for reduction mode copying. Such is the case in the apparatus 10 above-described. Due to space constraints the second lens 25' has not been moved laterally sufficiently to make the registration edge of the image on the copy sheet coincident for both reduction and base mode operation. As a result a side margin Y of the photoreceptor surface P, as shown in FIG. 11, is provided which is not imaged in reduction. Therefore, it will not be discharged by a light image and would develop out as a black border. In reduction the copy image is also smaller than the available imaging surface. Therefore, a side margin X due to the size of the copy image in reduction as compared to the copy image in a normal mode of operation is formed which similarly is not imaged and requires margin illumination to discharge it to prevent its development out of a black border.

The elongated margin illumination slots 205 and 205' in the apparatus 11 of this invention are configured to have a length which will be sufficient to allow them to illuminate the desired marginal bands X and Y of the photoreceptor surface P. The concave reflector 207 for increasing the amount of margin illumination need not extend over the total length of the illumination slit member 201, but should extend at least over the length of the slots 205 and 205'.

Therefore, it is apparent that in accordance with this invention a unique margin illumination system is provided which is selectively operable in a reduction mode for illuminating at least one margin of a photosensitive surface for preventing the development of that margin. The margin illumination system of this invention utilizes available light rays from within the optical system without the necessity of providing an auxiliary illumination system.

Preferably the light rays which are utilized are acted upon in a manner which causes them to depart from the normal optical ray path as applied to the photosensitive surface. The apparatus of this invention is particularly useful for illuminating side margin regions of a photosensitive surface which have their greatest extent in the direction of surface movement.

While the invention has been described by reference to the use of slots of fixed size, if desired, the slots could be made adjustable to vary the width of the margin which is illuminated. This might be accomplished by an adjustable shade similar to that described in the above-noted Simmons patent.

While the invention has been described by reference to the preferred embodiment which utilized a portion of the image rays for margin illumination any desired means for selectively applying illumination received directly or indirectly from the lamp 200 to the margins of the photosensitive surface could be employed.

The lens carriage 75, in accordance with this invention, preferably is translatable in a direction generally transversely of and normal to the optical ray paths.

It is not essential in accordance with the present invention to maintain a common registration edge of the copy sheet for both the base and reduction modes of operation.

In the disclosed optical system changing the conjugate distance effects changes in the projected image magnification according to the following relationship:

$$TC - \left[\frac{f + \frac{f}{m}}{\cos \alpha}\right] + \left[\frac{f + fm}{\cos \alpha}\right]$$

wherein:

| | |
|---|---|
| TC | — Total Conjugate |
| f | — Lens Focal Length |
| m | — Magnification |
| $\frac{f + \frac{f}{m}}{\cos \alpha}$ | — Object Conjugate |
| $\frac{f + fm}{\cos \alpha}$ | — Image Conjugate |
| $\alpha$ | — Angle between optical axis and lens axis |

For purposes of this application the total conjugate is defined as the distance along the principal ray from the object plane of the image plane. The object conjugate is defined as the distance along the principal ray from the object plane to the first nodal point of the lens and the image conjugate is defined as the distance along the principal ray from the image plane to the second nodal point of the lens.

The conjugate changing means in accordance with this invention has been described as being positioned on the object side of the lens, however, it should be apparent that if desired conjugate changing means could be employed on the image side of the lens.

While the invention has been described by reference to embodiments employing two scanning mirrors and a half lens in the optical system any desired optical system adapted to provide the desired exposure could be employed. In the stationary original mode of exposure the scanning need not be carried out by moving mirrors, e.g., a moving lens or other alternatives could be employed. While two lenses have been described in the preferred embodiment, if desired, a single lens which is translatable could be employed as in Hoppner et al. [2].

Image rays as the term is used in this application refers to all illumination rays derived from the illumination source and reflected from the object plane.

The patents, patent applications, and texts specifically set forth in this application are intended to be incorporated by reference into the description.

The term electrostatographic as employed in the present application refers to the formation and utilization of electrostatic charge patterns for the purpose of recording and reproducing patterns in viewable form.

It is apparent that there have been provided in accordance with this invention apparatuses which fully satisfy the objects, means and advantages set forth hereinbefore. While the invention has been described in conjunction with specific embodiments therefor, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. In a reproducing apparatus including means for forming an image on a sheet of final support material, said image forming means including means for viewing an object and for projecting an image thereof onto a photosensitive surface selectively at a first copy image magnification or at a second copy image magnification which is reduced as compared to said first copy image magnification, said viewing means including means for illuminating said object; said photosensitive surface being arranged for movement in a given direction; and further including means responsive to the selection of said second projected image magnification for illuminating at least one unused side margin region of said photosensitive surface, said side margin region being of greatest extent substantially in said given direction; the improvement wherein said means for illuminating said side margin region comprises:

means selectively operable in response to said second magnification selection for intercepting a portion of the illumination derived from said illumination means and for applying said portion of said illumination to said side margin.

2. An apparatus as in claim 1, wherein said selectively operable means includes a first reflector and means for supporting said first reflector for movement in and out of a light ray path derived from said illumination means, said first reflector being arranged so that when it is in said ray path, said selectively operable means illuminates said margin and when it is out of said ray path said selectively operable means does not illuminate said margin.

3. An apparatus as in claim 2, further including a mask means for limiting the illumination reflected by said first reflector for application to said imaging surface to said margin region.

4. An apparatus as in claim 3, further including at least one second reflector positioned between said mask means and said first reflector for illumination reflected from said first reflector and reflecting said illumination through said mask and onto said margin region of said surface.

5. An apparatus as in claim 4, wherein said second reflector comprises a concave reflector for increasing said illumination in said margin region.

6. An apparatus as in claim 2, wherein said viewing means comprises a multi-mode optical system, further including a third reflector which is arranged for scanning said object at a speed synchronized to the speed of said photosensitive surface, said third reflector receiving an image ray from said object and reflecting it, a fourth scanning reflector arranged to receive the reflected image ray from said third reflector and reflect it toward a lens, said fourth scanning reflector being arranged to scan at a speed one-half the speed of said third reflector, and wherein said first reflector comprises an add reflector wherein said light ray path comprises the reflective ray path from said fourth reflector, said first reflector being arranged to receive and reflect the image ray back to said fourth reflector for forming a reflection cavity therewith in a first mode of operation and out of the ray path in a second scanning mode of operation, means for fixing said third and fourth reflectors in a given position in said first mode of operation and means for feeding documents past said fixed reflectors at a speed synchronized to that of said imaging surface in said first mode of operation.

7. An apparatus as in claim 6, wherein said apparatus comprises an electrostatographic reproducing machine; wherein said photosensitive surface comprises a photoconductive surface and wherein said image forming means includes means for charging said surface, whereby the exposure to said projected image forms a latent electrostatic image thereon; means for developing said latent image to render it visible; and means for transferring said visible image to a sheet of final support material.

8. An apparatus as in claim 3, wherein said mask comprises part of a combination mask and illumination slit apparatus including an elongated member having a first elongated slot defining an illumination slit and at least one second elongated slot defining said margin region to be illuminated.

9. An apparatus as in claim 8, further including a non-reflecting light baffle positioned between said first and second slots

10. An apparatus as in claim 9, wherein said selectively operable means is arrangedto illuminate a plurality of side margins.

11. In a reproducing apparatus including means for forming an image on a sheet of final support material, said image forming means including means for viewing an object and for projecting an image thereof onto a moving photosensitive surface selectively at a first copy image magnification or at a second copy image magnification which is reduced as compared to said first copy image magnification; said viewing means including:

means for illuminating said object; a lens arranged along an optical ray path extending from said object to said surface; and means responsive to the selection of said second projected image magnification for illuminating at least one unused margin region of said photosensitive surface; the improvement wherein said means for illuminating said margin region comprises:

means arranged along said ray path between said lens and said object for intercepting a portion of the image rays and for applying said portion of the image rays to said margin region without passage through said lens.

12. An apparatus as in claim 11, wherein said intercepting and applying means is selectively operable and includes a first reflector and means for supporting said first reflector for movement in and out of said ray path, said first reflector being arranged so that when it is in said ray path, said selectively operable means illuminates said margin and when it is out of said ray path said selectively operable means does not illuminate said margin.

13. An apparatus as in claim 12, further including a mask means for limiting said portion of said image rays reflected by said first reflector for application to said imaging surface to said margin region.

14. An apparatus as in claim 13, further including at least one second reflector positioned between said mask means and said first reflector for illumination reflected from said first reflector and reflecting said illumination through said mask and onto said margin region of said surface.

15. An apparatus as in claim 14, wherein said second reflector comprises a concave reflector for increasing said illumination in said margin region.

16. An apparatus as in claim 12, wherein said viewing means comprises a multi-mode optical system, further including a third reflector which is arranged for scanning said object at a speed synchronized to the speed of said photosensitive surface, said third reflector receiving an image ray from said object and reflecting it, a fourth scanning reflector arranged to receive the reflected image ray from said third reflector and reflect it toward a lens, said fourth scanning reflector being arranged to scan at a speed one-half the speed of said third reflector, and wherein said first reflector comprises an add reflector wherein said light ray path comprises the reflective ray path from said fourth reflector, said first reflector being arranged to receive and reflect the image ray back to said fourth reflector for forming a reflection cavity therewith in a first mode of operation and out of the ray path in a second scanning mode of operation, means for fixing said third and fourth reflectors in a given position in said first mode of operation and means for feeding documents past said fixed reflectors at a speed synchronized to that of said imaging surface in said first mode of operation.

17. An apparatus as in claim 16, wherein said apparatus comprises an electrostatographic reproducing machine; wherein said photosensitive surface comprises a photoconductive surface and wherein said image forming means includes means for charging said surface, whereby the exposure of said projected image forms a latent electrostatic image thereon; means for developing said latent image to render it visible; and means for transferring said visible image to a sheet of final support material.

18. An apparatus as in claim 13, wherein said mask comprises part of a combination mask and illumination slit apparatus including an elongated member having a first elongated slot defining an illumination slit and at least one second elongated slot defining said region to be illuminated.

19. An apparatus as in claim 18, further including a non-reflected light baffle separating said first and second slots.

20. An apparatus as in claim 19, wherein said selectively operable means is arranged to illuminate a plurality of margins.

* * * * *